United States Patent [19]

Kazuo et al.

[11] Patent Number: 4,603,684

[45] Date of Patent: Aug. 5, 1986

[54] GAS COOKING DEVICE

[75] Inventors: Ozawa Kazuo; Yoinara Saburo, both of Tokyo, Japan

[73] Assignee: Balibali System Co., Ltd., Tokyo, Japan

[21] Appl. No.: 753,576

[22] Filed: Jul. 10, 1985

[51] Int. Cl.[4] ..... F24C 15/20

[52] U.S. Cl. ..... 126/299 R; 126/41 R; 126/300; 126/215; 98/115.1

[58] Field of Search ..... 126/299 R, 299 D, 299 C, 126/300–303, 21 A, 21 R, 25 R, 25 A, 214 A, 214 C, 215, 216; 98/115.1

[56] References Cited

U.S. PATENT DOCUMENTS

| | | | |
|---|---|---|---|
| 3,002,513 | 10/1961 | Morasch | 126/299 R |
| 3,664,322 | 5/1972 | Clark | 126/25 A |
| 4,335,705 | 6/1982 | Kiyomitu | 126/299 R |

*Primary Examiner*—James C. Yeung

*Attorney, Agent, or Firm*—Wenderoth, Lind & Ponack

[57] ABSTRACT

This invention relates to a gas cooking device comprising a circular gas burner and a mounting member such as a tripod on which an article to be directly cooked or a cooking container such as a pan or pot is to be mounted. The gas cooking device further comprises a cooking container adjuster which serves to adjust a vertical position of the cooking container to adjustably set a distance between a bottom of the cooking container and the gas burner in accordance with the configuration of the bottom of the cooking container. The cooking device further comprises forced exhaust means to discharge exhaust gas, smoke or steam which is produced from the cooked food. Thus, the invention allows a cover to be omitted.

3 Claims, 8 Drawing Figures

GAS COOKING DEVICE

BACKGROUND OF THE INVENTION

Many prior gas cooking devices having no cover are exclusively used only for baking meat or for cooking food via a cooking container such as a pan or pot. Such prior gas cooking devices comprise a square gas burner and a square rooster disposed above the gas burner. One of the prior cooking devices further comprises forced exhaust means to forcibly discharge from the inside of a cooking table exhaust gas, smoke and steam which tend to be produced when directly cooking food such as baking meat, for example. Although such a cooking device can be used for cooking by use of the cooking container such as a pot, heat cannot be effectively transferred to the cooking container because the cooking device is in the form of a square while the cooking container is normally circular. Thus, it will be noted that gas will be wastefully consumed or it will take too much time to cook food.

Gas cooking devices having no cover and having a circular gas burner which are well known, such as a portable cooking furnace or gas range have been used, but since they have an improper distance between the bottom of the cooking container and the gas flame due to the configuration of the bottom of the cooking container such as the degree of curvature, heat of combustion gas cannot be effectively transferred to the cooking container. Furthermore, since such gas cooking devices have no forced exhaust means, they cannot be used for directly cooking food such as meat.

SUMMARY OF THE INVENTION

Accordingly, it is a principal object of the invention to provide a gas cooking device adapted to either directly cook food or indirectly cook it by use of a cooking container.

It is another object of the invention to provide a gas cooking device adapted to effectively transfer heat from a gas burner to a cooking container with food to be cooked.

It is a further object of the invention to provide a gas cooking device adapted to forcibly discharge exhaust gas, smoke or steam from the inside of a gas table even when it is used for indirectly cooking food.

In accordance with the present invention, there is provided a gas cooking device comprising a table having a table body corresponding to a leg of said table and a top plate mounted on said table body and a combustion heater disposed at a center of said top plate of said table and including a circular gas burner provided at a center of an outer housing.

The combustion heater includes an annular outer holder having guides provided at the inner periphery of said outer holder to set a vertical position of an inner holder at the proper level and an inner housing removably disposed so as to form an exhaust duct between said outer and inner housings, said exhaust duct having an inlet provided at the outer periphery of said outer holder, a catching plate removably provided inside of said inner housing and below said gas burner to receive leaked soup, and a top plate removably provided at the upper outer edge of said combustion heater.

BRIEF DESCRIPTION OF THE DRAWINGS

The above and other objects and features of the invention will be apparent from the description of the embodiment of the invention taken along with reference to the accompanying drawings.

DETAILED DESCRIPTION OF THE PREFERRED EMBODIMENT

Figure 1:
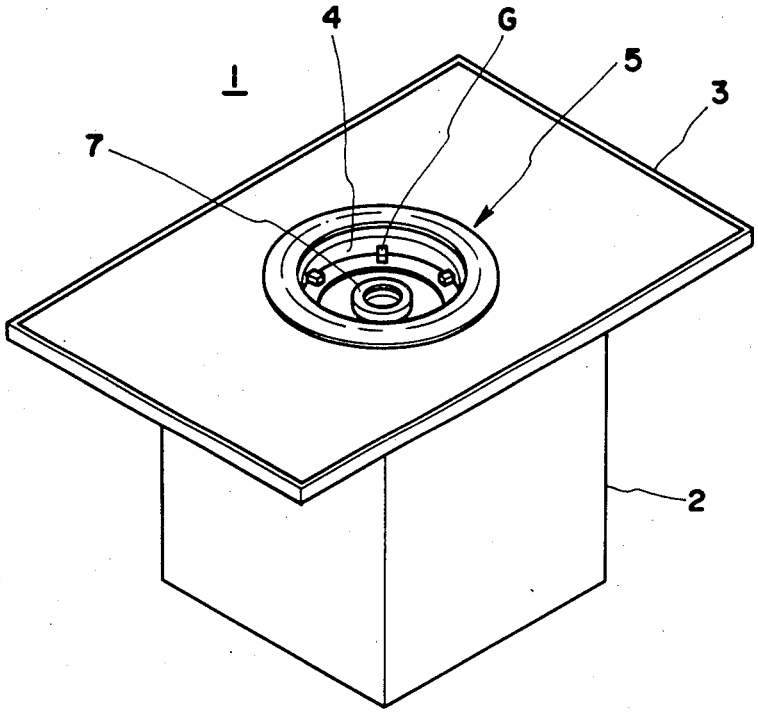
FIG. 1 is a perspective view of a gas cooking device constructed in accordance with one embodiment of the invention.
Figure 2:
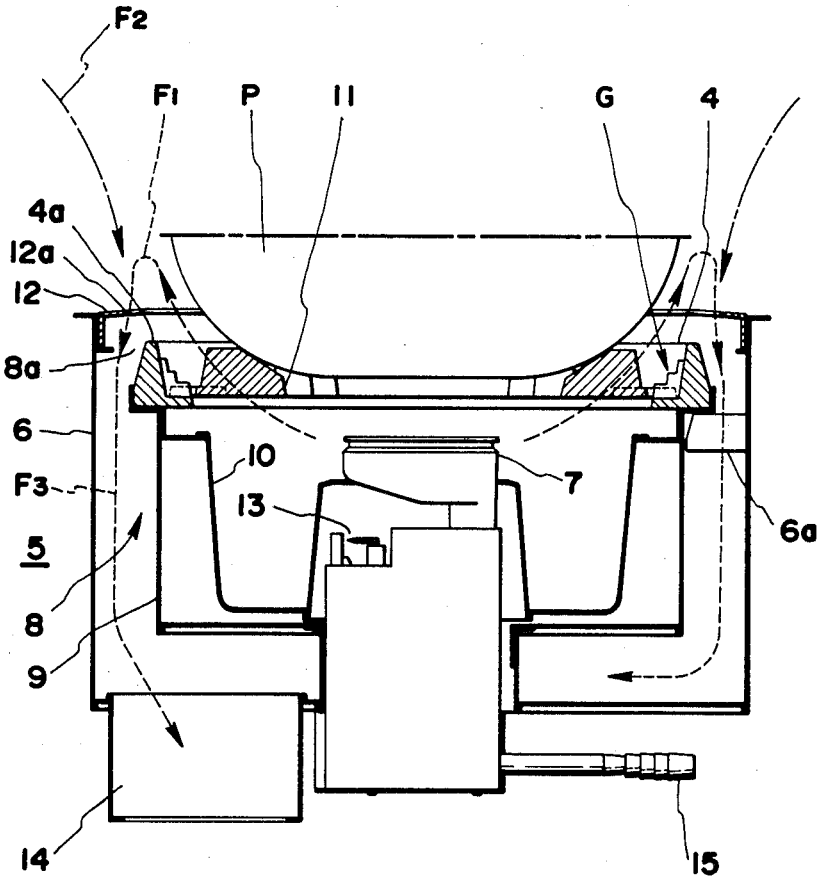
FIG. 2 is an enlarged cross sectional view of a combustion heater when a cooking container is used on the heater.

Referring now to FIGS. 1 and 2 of the accompanying drawings, there is shown a gas cooking device 1 comprising a table having a table body 2 corresponding to a leg of the table and a top plate 3 mounted on the table body 2 and a combustion heater 5 having an annular outer holder 4 disposed at an upper portion thereof and including guides G which constitute a vertical position adjuster to vertically adjust an inner holder such as a tripod used for mounting a cooking container such as a pot. As shown in FIG. 2, the combustion heater 5 comprises a gas burner 7 disposed at a center of an outer housing 6 and an exhaust duct 8 defined by the outer housing 6 and an inner housing 9 which is in turn disposed between the outer housing 6 and the gas burner 7. The exhaust duct 8 has an inlet 8*a* provided adjacent to the periphery of the outer holder 4. The exhaust duct 8 serves to collectively inhale a combustion gas F1 and a composite gas F2 of outer air and steam produced by cooking to introduce them as exhaust gas F3 into a collective duct not shown.

A catching plate 10 may be provided inside of the inner housing 9 and below the gas burner 7 to receive soup or the like leaked from the cooking container. The catching plate 10 may be preferably removably mounted on the inner housing 9 so as to be able to discharge the soup or to allow one to clean it. Above the catching plate 10, there is disposed an inner holder 11 which is mounted on the inner periphery of the outer holder 4. The inner holder 11 serves to support a cooking container P such as a pot at a proper vertical position. A top plate 12 may be preferably provided to decorate an upper edge of the combustion heater 5. The top plate 12 has an inner periphery 12*a* so set to be positioned inside of the outer periphery 4*a* of the outer holder 4. This causes absorption force of the exhaust duct 8 to be dispersed. Thus it will be noted that the combustion gas F1 of high temperature is prevented from being reversely forced by the outer composite gas F2. This means that the combustion gas F1 will contact the bottom of the cooking container P to effectively transfer heat thereto. The gas burner 7 includes an electric ignition device 13. A well known fire volume damper 14 may be provided which serves to automatically cut off an exhaust passage by detecting an abnormal temperature of the exhaust gas by a fuse or the like. A gas is introduced into the combustion heater 5 through a plug 15.

Figure 3:
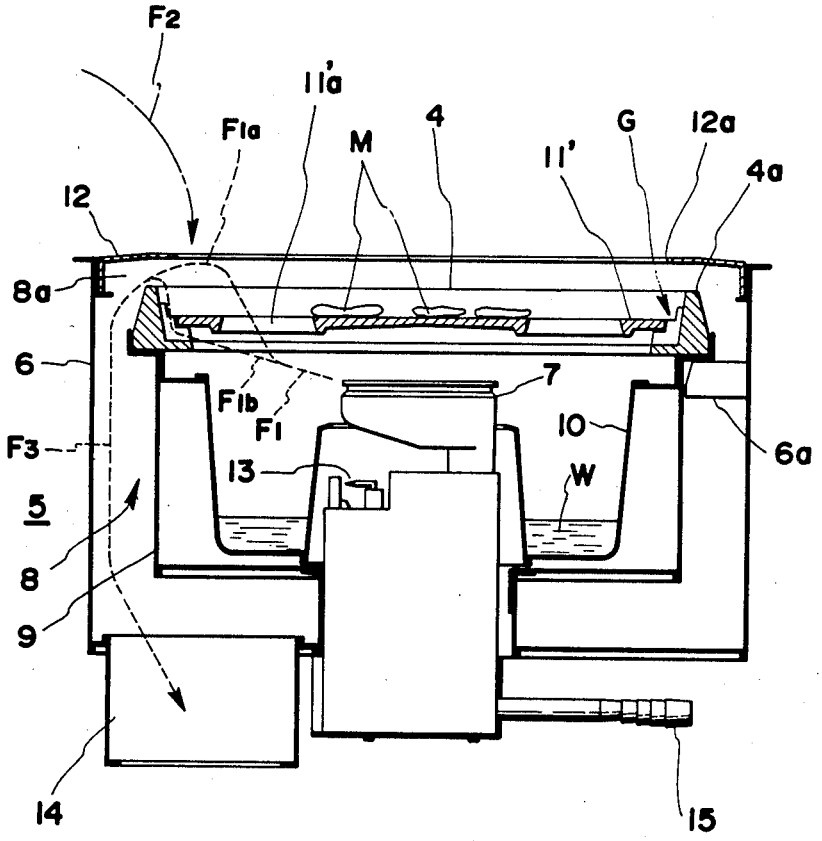
FIG. 3 is an enlarged cross sectional view of the combustion heater when a rooster is used for directly cooking food.

FIG. 3 illustrates the combustion heater 5 in the case of directly cooking food without using the cooking container P of FIG. 2. In this case, a roaster 11' is mounted on the outer holder 4 in place of the inner tripod 11 so that it is spaced from the bottom of the outer holder 4. Even if an exhaust passage 11'a in the roaster 11' is blocked by food M such as meat, an exhaust route (exhaust flow F1*b*) will be positively maintained. As aforementioned, since the inner periphery 12a of the top plate 12 is positioned inside of the outer periphery 4a of the outer holder 4, wasteful outer air is never drawn into the exhaust duct 8 so that more smoke and steam will be effectively drawn thereinto instead. The catching plate 10 can receive oil or meat soup dropped from the food M. In this case, water W is preferably placed in the catching plate 10 because subsequent treatment of the dropped food M becomes easier.

Figure 4:
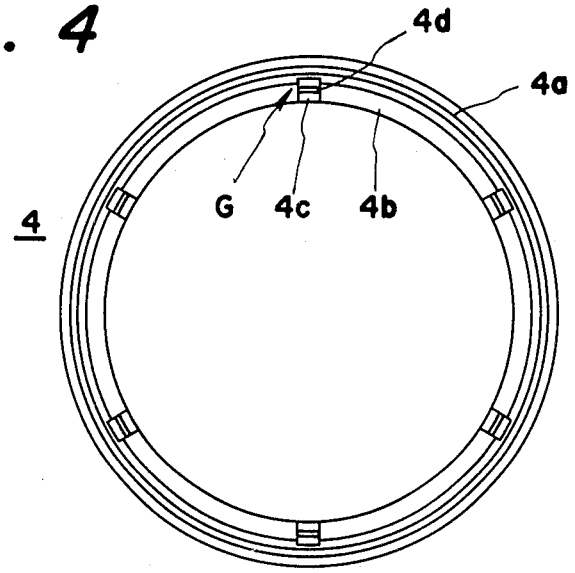
FIG. 4 is a plan view of an outer holder having a vertical position adjusting mechanism.
Figure 5:
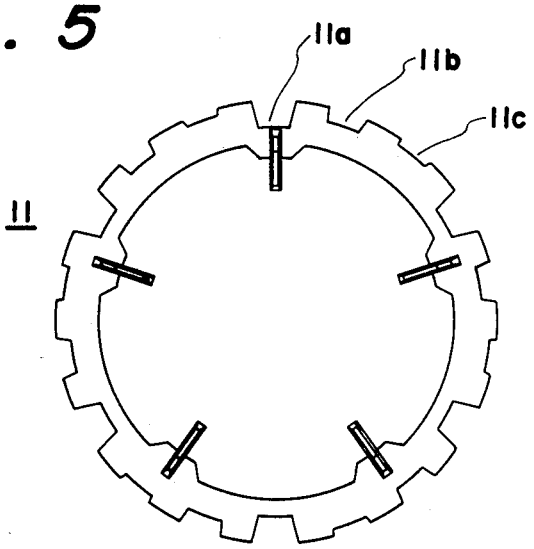
FIG. 5 is a plan view of an inner holder to be vertically adjusted relative to the outer holder of FIG. 4.
Figure 6:
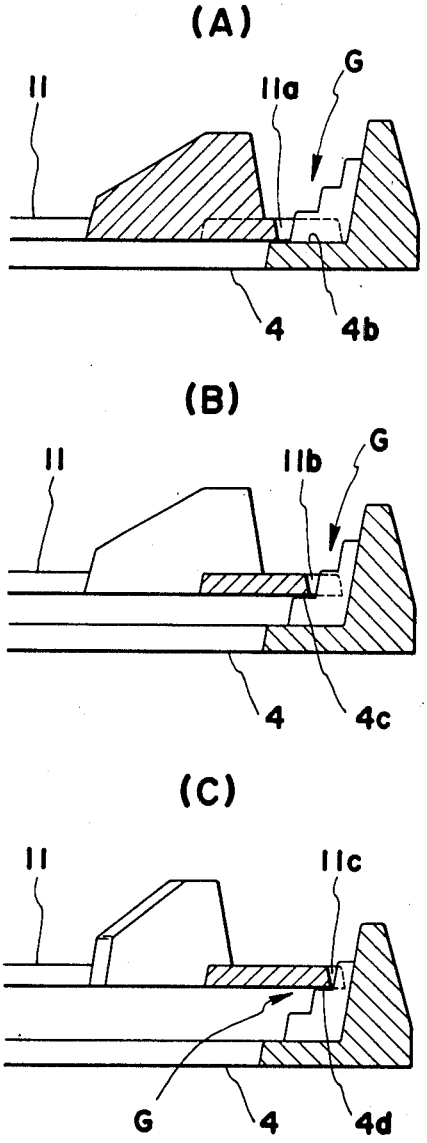
FIG. 6A is a partially enlarged cross sectional view of the inner holder disposed at the lowest position by means of the vertical position adjusting mechanism of the outer holder.
FIG. 6B is a partially enlarged cross sectional view of the inner holder disposed at the middle position by means of the vertical position adjusting mechanism of the outer holder.
FIG. 6C is a partially enlarged cross sectional view of the inner holder disposed at the highest position by means of the vertical position adjusting mechanism of the outer holder.

A vertical position adjusting mechanism for the outer holder 4 and inner holder 11 is based on a relative construction, as shown in FIGS. 4 and 5. More particularly, guides G on the inner periphery of the outer holder 4 are formed in a stepped manner. In the illustrated embodiment, they may have three stepped portions 4a, 4b and 4c which correspond to grooves 11a, 11b and 11c provided in the inner holder 11 so as to align with the guides G of the outer holder 4 and having different depths. FIGS. 6A through 6C illustrate different combinations of the stepped portions 4a through 4c and the grooves 11a through 11c. In FIG. 6A, the guides G engage the deepest grooves 11a in which the bottom of the inner holder 11 engages the lowest stepped portion 4b so that the inner holder 11 is positioned at the lowest level. In FIG. 6B, the guides G engages the middle grooves 11b in which the bottom of the inner holder 11 engages the middle stepped portion 4c so that the inner holder 11 is positioned at the middle level. In FIG. 6C, the guides G engage the shallowest grooves 11c in which the bottom of the inner holder 11 engages the highest stepped portion 4d so that the inner holder 11 is positioned at the highest level. Thus, it will be noted that the inner holder 11 can be positioned at a proper level so that the cooking container P can be located relative to a combustion flame. This causes heat from the combustion heater 5 to be effectively transferred to the cooking container P.

Although one preferred embodiment of the invention has been illustrated and described with reference to the accompanying drawings, it will be understood by those skilled in the art that it is only one example, and that various changes and modification may be made without departing from the spirit and scope of the invention, which is intended to be defined only by the appended claims.

We claim:

1. A gas cooking device comprising:

a table body;

a top plate being removably mounted on the table body and having a center and an inner periphery;

a combustion heater being disposed at the center of the top plate and having an outer housing with a center corresponding to the center of the top plate;

a circular gas burner provided at the center of the outer housing;

an inner housing removably disposed within the combustion heater so as to form an exhaust duct with the outer housing;

an annular outer holder being mounted on the inner housing and having an inner periphery and an outer periphery;

an annular inner roaster being supported over the circular gas burner by the outer holder and having an outer periphery;

stepped guide means, provided at the inner periphery of the outer holder, for setting a vertical position of the inner holder at a selected one of the plurality of stepped levels;

groove means, provided along the outer periphery of the inner roaster, for mating with the stepped guide means of the outer holder;

an exhaust duct inlet provided at the outer periphery of the outer holder; and a catch plate means, removably provided inside of the inner housing and below the circular gas burner, for receiving leaked food material;

wherein said inner periphery of the top plate extends over the exhaust duct inlet so as to be positioned inside of the outer periphery of the inner roaster when the inner roaster is used for directly cooking food material thereon;

whereby outer gas is not drawn into the exhaust duct so that more smoke and steam instead will be effectively drawn into the exhaust duct.

2. A gas cooking device as set forth in claim 1 further comprising a fire volume damper having a fuse to detect a temperature of said combustion heater.

3. A gas cooking device comprising:

a table body;

a top plate being removably mounted on the table body and having a center and an inner periphery;

a combustion heater being disposed at the center of the top plate and having an outer housing with a center corresponding to the center of the top plate;

a circular gas burner provided at the center of the outer housing;

an inner housing removably disposed within the combustion heater so as to form an exhaust duct with the outer housing;

an annular outer holder being mounted on the inner housing and having an inner periphery and an outer periphery;

an annular inner holder being supported over the circular gas burner by the outer holder and having an outer periphery;

stepped guide means, provided at the inner periphery of the outer holder, for setting a vertical position of the inner holder at a selected one of the plurality of stepped levels;

groove means, provided along the outer periphery of the inner holder, for mating with the stepped guide means of the outer holder;

an exhaust duct inlet provided at the outer periphery of the outer holder; and a catch plate means, removably provided inside of the inner housing and below the circular gas burner, for receiving leaked food material;

wherein said inner periphery of the top plate allows the exhaust duct inlet to be open to the outer atmosphere and further whereby said inner periphery of the top plate is positioned outside of the outer periphery of the inner holder when the inner holder is used for indirectly cooking food material thereon through the medium of a cooking container;

whereby combustion gas of high temperature is allowed to be drawn into the exhaust duct inlet and, also, is prevented from being reversibly forced back around the circular gas burner by outer gas so that the combustion gas contacts a bottom of the cooking container so as to effectively transfer heat thereto.

* * * * *